US009149098B2

(12) United States Patent
Venturi

(10) Patent No.: US 9,149,098 B2
(45) Date of Patent: Oct. 6, 2015

(54) FOLDABLE ARTICULATED ARM

(76) Inventor: Federico Venturi, Milan (IT)

( * ) Notice: Subject to any disclaimer, the term of this patent is extended or adjusted under 35 U.S.C. 154(b) by 65 days.

(21) Appl. No.: 14/118,713

(22) PCT Filed: May 24, 2012

(86) PCT No.: PCT/IB2012/052612
§ 371 (c)(1),
(2), (4) Date: Nov. 19, 2013

(87) PCT Pub. No.: WO2012/160537
PCT Pub. Date: Nov. 29, 2012

(65) Prior Publication Data

US 2014/0102495 A1 Apr. 17, 2014

(30) Foreign Application Priority Data

May 25, 2011 (IT) ..... MI2011A0938

(51) Int. Cl.

| | |
|---|---|
| ***A45B 25/02*** | (2006.01) |
| ***A45B 15/00*** | (2006.01) |
| ***A45B 19/10*** | (2006.01) |
| ***A45B 19/04*** | (2006.01) |

(52) U.S. Cl.
CPC ..... *A45B 25/02* (2013.01); *A45B 15/00* (2013.01); *A45B 19/04* (2013.01); *A45B 19/10* (2013.01)

(58) Field of Classification Search
None
See application file for complete search history.

(56) References Cited

U.S. PATENT DOCUMENTS

| | | | | |
|---|---|---|---|---|
| 3,252,468 | A | 5/1966 | Militano | |
| 4,821,756 | A | 4/1989 | England | |
| 5,235,997 | A | 8/1993 | Good | |
| 5,553,634 | A * | 9/1996 | Yang | 135/25.3 |
| 6,230,725 | B1 | 5/2001 | Ko | |
| 6,394,115 | B1 * | 5/2002 | Tsun | 135/25.3 |
| 6,758,228 | B1 * | 7/2004 | You | 135/29 |
| 6,948,506 | B2 * | 9/2005 | Wang | 135/28 |
| 7,591,274 | B2 * | 9/2009 | Lin et al. | 135/15.1 |
| 2006/0151020 | A1 * | 7/2006 | Lin et al. | 135/25.1 |

(Continued)

FOREIGN PATENT DOCUMENTS

| | | |
|---|---|---|
| CN | 2751622 | 1/2006 |
| CN | 2935909 | 8/2007 |
| CN | 201025940 | 2/2008 |

(Continued)

OTHER PUBLICATIONS

International Search Report and Written Opinion dated Oct. 15, 2012 from counterpart PCT App No. PCT/IB2012/052612.

(Continued)

*Primary Examiner* — Winnie Yip
(74) *Attorney, Agent, or Firm* — Timothy J. Klima; Shuttleworth & Ingersoll, PLC

(57) ABSTRACT

It is described a foldable articulated arm comprising a first rod-shaped element, a second rod-shaped element and a third rod-shaped element foldable one another and at least three stretching element of the rod-shaped elements, arranged to form a system of four-bar linkages, further comprising a plurality of joint elements of the rod-shaped elements and the stretching elements and having, at the opposite ends, a retaining mechanism for a respective combining with a tube and an umbrella sheet, wherein the rod-shaped elements, the joint elements, the stretching elements and the retaining mechanism are all made integral in a single piece of plastic material constituting the foldable articulated arm.

20 Claims, 8 Drawing Sheets

(56) References Cited

U.S. PATENT DOCUMENTS

| | | | | |
|---|---|---|---|---|
| 2009/0126769 | A1* | 5/2009 | Hoogendoorn | 135/98 |
| 2011/0240075 | A1* | 10/2011 | Kahng | 135/31 |

FOREIGN PATENT DOCUMENTS

| | | | | | |
|---|---|---|---|---|---|
| CN | 201192156 | | 2/2009 | | |
| CN | 201790123 | | 4/2011 | | |
| GB | 1288580 | | 9/1972 | | |
| GB | 2267640 | A * | 12/1993 | | A45B 25/10 |
| GB | 2452558 | A * | 3/2009 | | A45B 25/02 |

OTHER PUBLICATIONS

Office Action dated Dec. 2, 2014 issued by the State Intellectual Property Office of P.R. China for corresponding application No. 2012800254933.

* cited by examiner

SECTION Y-Y

DETAIL A

DETAIL B

DETAIL C

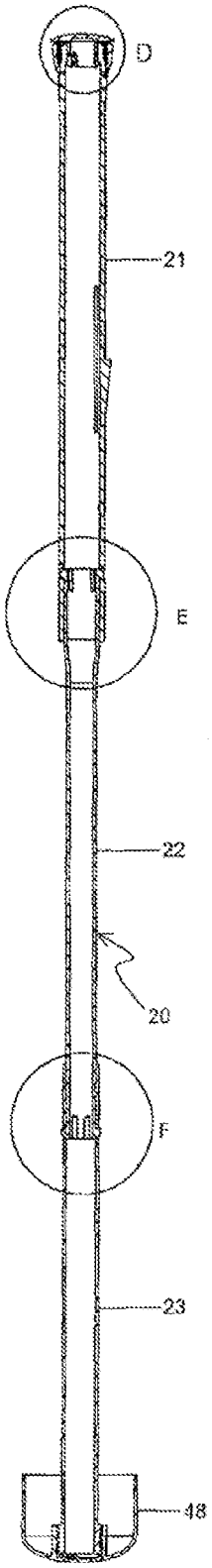
SECTION X-X fig. 8
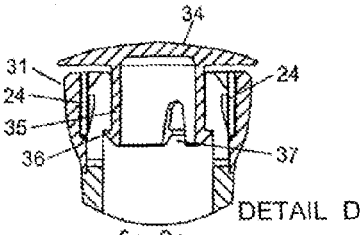
fig. 9a
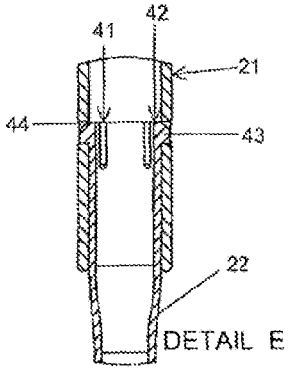
fig. 9b
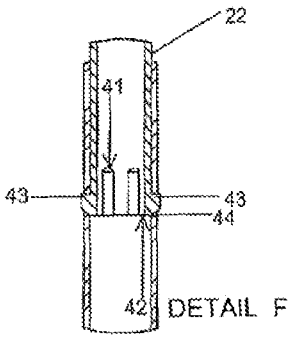
fig. 9c

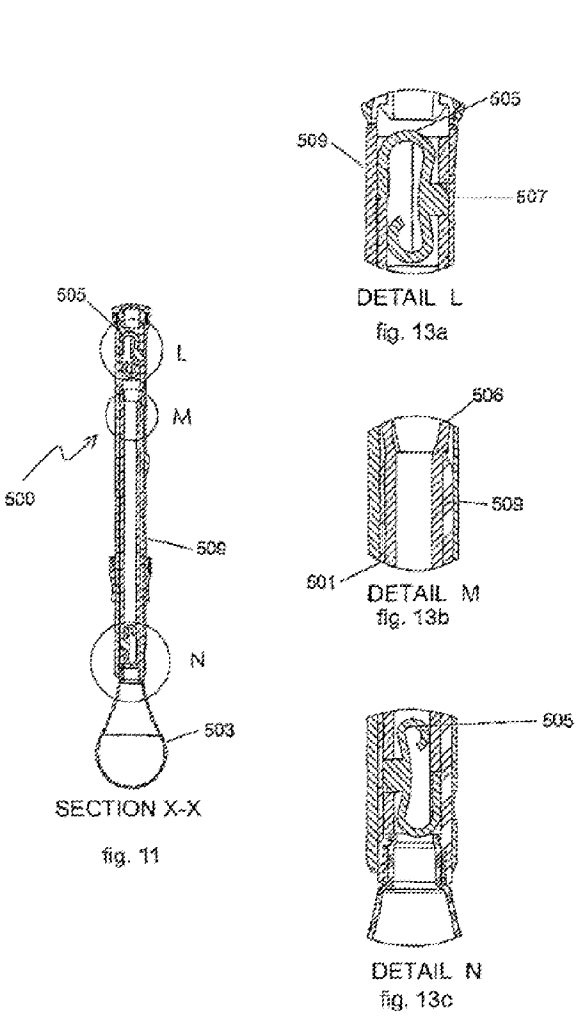
505
507
509
DETAIL L
fig. 13a
506
508
501
DETAIL M
fig. 13b
505
DETAIL N
fig. 13c
L
M
508
N
503
505
500
SECTION X-X
fig. 11
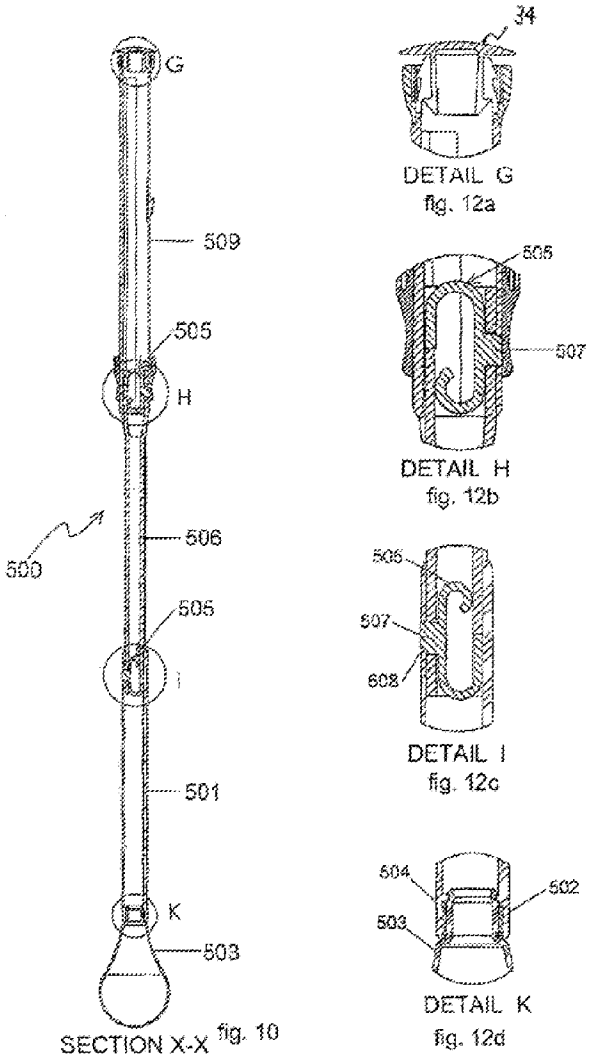
34
DETAIL G
fig. 12a
505
507
DETAIL H
fig. 12b
505
507
508
DETAIL I
fig. 12c
502
504
503
DETAIL K
fig. 12d
G
509
505
H
506
505
I
501
K
503
500
SECTION X-X fig. 10

FOLDABLE ARTICULATED ARM

This application is the National Phase of International Application PCT/1B2012/052612 filed May 24, 2012 which designated the U.S. and that International Application was published under PCT Article 21(2) in English.

This application claims priority to Italian Patent Application No. MI2011A000938filed May 25, 2011, the entirety of which is incorporated by reference herein.

FIELD OF THE INVENTION

In its more general aspect the present invention relates to a foldable articulated arm specifically but not exclusively for umbrellas.

STATE OF THE ART

As known the umbrellas are items diffused for centuries and largely used worldwide to shelter from the rain or the sun, which lately gained currency as clothing accessories inspiring trends and influencing user styles and tastes.

Just because of their utility, diffusion and acquired status of object or accessory decorative too, the known art provided a great variety of umbrellas which essentially are divided in foldable umbrellas and unfoldable umbrellas, the former having reduced size when closed due to a telescopic tube and a structure comprising foldable arms.

Among the more common models of foldable umbrellas there are those comprising articulated arms with three or five segments, made of aluminium and having hinge points consisting in rivets.

Such umbrellas, although advantageous, suffer from some drawbacks among which having a low strength structure.

The aluminium arms, in fact, both for reducing weight and costs and for reducing the umbrella bulk when closed, generally have extremely reduced sections, thus low-strength particularly in the hinge points which inter alia, in umbrellas of the afore said type, are some tens in total.

The hinge points made by rivets are also prone to rust which can further impair the strength of the articulated arms, as well as the functionality and aesthetical appearance of the whole umbrella.

The afore said drawbacks determine a poor resistance to wind blasts in general and to the tilting or "overturning" of the umbrella sheet in particular, but also frequent failure during the normal opening and closing operations of the umbrella.

Foldable umbrellas are then known comprising a stronger structure but particularly complex to realize and most of all to assembly, due to the number of pieces forming each articulated arm, which have to be assembled with skills and precision, in order to avoid an incomplete opening or closing of the structure of the umbrella.

Such umbrellas suffer from the further drawback of being expensive and they comprise, for example, foldable arms consisting in rods on whose ends connecting elements comprising joints are fitted.

Other foldable umbrellas provided in the known art, on the other hand, suffer from the drawback of being too heavy or too cumbersome to be appreciated by the user which, relying on a foldable umbrella, expects the latter to be easy to handle and light, as well as adapted to be put aside, when not used, in small luggage or bags without causing uncomfortableness to the user.

Briefly, despite a number of solutions provided in the known art, it is generally found that different drawbacks are associated to the different known embodiments of foldable umbrellas, whereas a foldable umbrella, independently from its specific structure, should have all those features so that to make it durable in time, practical and cost effective as well as comfortable both when opened and used and when closed and carried in a hand luggage, for example.

SUMMARY OR THE INVENTION

Object of the present invention is therefore to provide a foldable articulated arm, specifically but not exclusively for a foldable umbrella, having structural and functional features such to overcome the drawbacks mentioned referring to the known art, i.e. a foldable articulated arm of the abovementioned type having a high strength, which is particularly light, provided with small overall dimensions both in extended arrangement and in folded arrangement, without the need for long times or specific ability for its assembling or its realization and being particularly cost effective at the same time.

Therefore according to a first aspect the present invention provides a foldable articulated arm realized in a single piece of plastic material, advantageously by injection molding.

Substantially, according to the invention, an articulated arm of the afore said type is provided comprising three segments or portions foldable one another, specifically two ending portions arranged on sides opposite to an intermediate portion, each one including a respective rod-shaped element, and further comprising a plurality of stretching elements of the afore said rod-shaped elements, specifically at least three stretching elements, a plurality of joint elements of the afore said rod-shaped elements and the afore said stretching elements and having, at the opposite ends, retaining means for a respective combining or constraint with a tube and with a sheet of an umbrella, wherein the afore said rod-shaped elements, the afore said joint elements, the afore said stretching elements and the afore said retaining means are all made integral in the afore said single piece of plastic material.

As regard to the arrangement of the afore said stretching elements, one with respect to each other and to the afore said rod-shaped elements, as well as to the relevant combining of the rod-shaped elements themselves, it should be said that it is substantially of a known type and it follows a system of four-bar linkages used in the currently commercially available umbrellas.

Briefly, in the afore said arrangement, the afore said three rod-shaped elements are arranged so that a first rod-shaped element has one free end and one opposite end hinged to a second rod-shaped element which in turn has one end hinged to a third rod-shaped element having a free end itself too.

Again, of the at least three stretching elements, a first stretching element has one free end and one opposite end hinged to the afore said first rod-shaped element, a second stretching element has one end hinged to the afore said first stretching element and one opposite end hinged to the afore said second rod-shaped element and a third stretching element has one end hinged to the afore-said first rod-shaped element and one opposite end hinged to one end of the afore said third rod-shaped element.

Advantageously, in accordance with the invention, the afore said third stretching element essentially comprises a flexible ribbon.

Preferably, the afore said flexible ribbon is constrained to the afore said second rod-shaped element, advantageously by a runner sliding on the second rod-shaped element.

Advantageously, according to the invention, the afore said runner is made in a single piece with the afore said flexible ribbon and it comprises at least one first lug having limited set length, right-angle folded and jutting from an edge of the flexible ribbon engaging a back side of the afore said second rod-shaped element, the back side opposite to the flexible ribbon, or a first longitudinal groove provided in a side of the second rod-shaped element.

Preferably the afore said runner also comprises a second lug similar to the afore said first lug but jutting from the opposite edge of the flexible ribbon, engaging the same afore said back side of the second rod-shaped element or a second longitudinal groove opposite to the afore said first groove of the second rod-shaped element.

The afore said first and second lug can be arranged in position facing one to each other, that is in symmetrical position with respect to a longitudinal plane of the flexible ribbon, or they can be arranged on the latter in positions shifted one from another (consecutive positions), as it is preferred.

Still in accordance with the invention, the afore said second stretching element can be rigid or semi-rigid, for example similar to the three afore said rod-shaped elements and to the first stretching element, or it essentially consists of a flexible element similar to the above described element for the third stretching element, that is to say essentially of a flexible ribbon.

Preferably, in case of a second stretching element essentially consisting of a flexible ribbon, the present foldable articulated arm also comprises a fourth stretching, rigid or semi-rigid, element having one end hinged to the afore said first stretching element and one opposite end hinged to the afore said second rod-shaped element, which is interposed between the first rod-shaped element and the second stretching element.

According to the invention each one of the afore said joint elements, which form the hinged ends of the rod-shaped elements or of the stretching elements in accordance with what above mentioned, essentially consists of one ending portion, with limited set length, of the respective rod-shaped or stretching element, having a reduced cross section with respect to a main body of the same respective rod-shaped or stretching element, such to become particularly flexible of foldable.

Still in accordance with the invention, the afore said retaining means comprise tooth-shaped ending portions of the afore said free ends of the first and third rod-shaped elements and the first stretching element which forms the male component of a so called "snap-fit" coupling, that is to say a substantially irreversible snap-fit coupling, or alternatively for the third rod-shaped element one ending portion folded onto the third rod-shaped element itself, in practice a tab defining a notch between itself and a main body of the third rod-shaped element.

Preferably the afore said ending portions comprising the afore said tooth or the afore said tab have a reduced cross section with respect to a main body of the respective rod-shaped or stretching element.

Preferably the afore said rod-shaped elements, and more preferably the afore said stretching elements too when provided rigid or semi rigid, have a "T"—or a "I"—or a "H"—shaped cross section.

In accordance with the invention, the present foldable articulated arm can be made of a single plastic material, for example polyethylene or polypropylene or a copolymer thereof, or two different, co-molded plastic materials can be provided specifically a first high density plastic material for the main bodies of the rod-shaped and stretching elements, and a second plastic material with density lower than the first plastic material for the joint elements and possibly for the retaining means.

As above mentioned, the present foldable articulated arm can be used to make a structure for a foldable umbrella and, still according to the invention, it can be used to make other supporting structures too, such as for example stands for table lamps and the like, in which an articulation of the supporting structure is required, such as the movement between at least one withdrawn position and one extended position.

In case of use for an umbrella, the present foldable articulated arm is combined with a tube, from the side of the afore said free ends of the first rod-shaped element and the first stretching element, and with a sheet from the side of the free end of the afore said third rod-shaped element, specifically at the retaining means provided on the afore said free ends.

Therefore, in accordance with a further aspect, the present invention also provides a foldable umbrella essentially comprising a plurality of articulated arms of the above considered type, a tube, preferably telescopic, and a sheet, preferably waterproof, the afore said tube and the afore said sheet being combined and constrained to each articulated arm as above reported.

Specifically the invention provides an umbrella of the afore said type, preferably having eight foldable articulated arms of the above considered type, wherein the afore said telescopic tube comprises at least three tubular elements.

Preferably the afore said telescopic tube comprises a first tubular element the plurality of foldable articulated arms is combined therewith, a second tubular element slidingly mounted inside the first tubular element and adapted to slide between a first position in which it is substantially inside the first tubular element and a second position in which it is at least partially outside of the first tubular element, and a third tubular element slidingly mounted outside of the second tubular element and adapted to slide between a position in which it is substantially inside the first tubular element and a position in which it is at least partially outside thereof and the second tubular element.

For the afore said combining of the plurality of foldable articulated arms with the tube, the umbrella according to the invention comprises suitable housing seats of the afore said retaining means of the first rod-shaped element and the first stretching element which make respective female components for the afore said "snap-fit" coupling.

Advantageously a first plurality of housing seats for the respective plurality of retaining means of the first rod-shaped elements is provided at one end of the afore said first tubular element, specifically the free end, and a second plurality of housing seats for the respective plurality of retaining means of the first stretching elements is provided on one annular element, fitted onto the first tubular element and sliding on it between a first position in which the afore said articulated arms are closed and a second position in which the afore said articulated arms are extended.

Preferably the umbrella according to the invention comprises stopping means of the travel of the afore said annular element made in a single piece with the afore said first tubular element, and means for stopping the mutual travel of the tubular elements made integral with them, without however excluding the possibility of providing means for stopping the mutual travel of the tubular elements having the shape of respective springs, removably combined with the tubular elements.

Preferably the umbrella according to the invention also comprises combining means of the threaded type, advantageously at one ending portion of the afore said third tubular element, specifically the free end, and a handle or base removably combined with the third tubular element at the afore said combining means of the threaded type.

For the afore said combining or constraint of the plurality of foldable articulated arms with the afore said sheet, the umbrella according to the invention comprises a respective plurality of fastening elements, such as of cap type, to which the sheet is fastened at the relative apices, each one provided with a housing seat for a respective retaining means of a relative third rod-shaped element which makes the female component of the afore said "snap-fit" coupling, although not excluding the possibility of providing a direct constraint between sheet and third rod-shaped element, specifically between sheet and ending portion of the third rod-shaped element in case the portion comprises the afore said tab defining the afore said notch.

Preferably the afore said sheet is a film of plastic material fastened to the plurality of fastening elements or directly to the tab of each third rod-shaped element by heat or ultrasonic welding, and more preferably the sheet is fastened to each one of the afore said articulated arms according to the invention in two other points comprised between the tube and the free end of each third rod-shaped element, advantageously always by welding.

Preferably the present foldable umbrella is integrally made of plastic material, advantageously a recyclable plastic material of the above considered type.

The above described umbrella can be a walking umbrella or a beach or bar umbrella.

DETAILED DESCRIPTION OF THE FIGURES

Further characteristics and advantages of the present invention will be more evident from a review of the following description of some preferred, but not exclusive, embodiments, shown for illustration purposes only and without limitation, with the aid of the attached drawings, in which.

Figure 1:
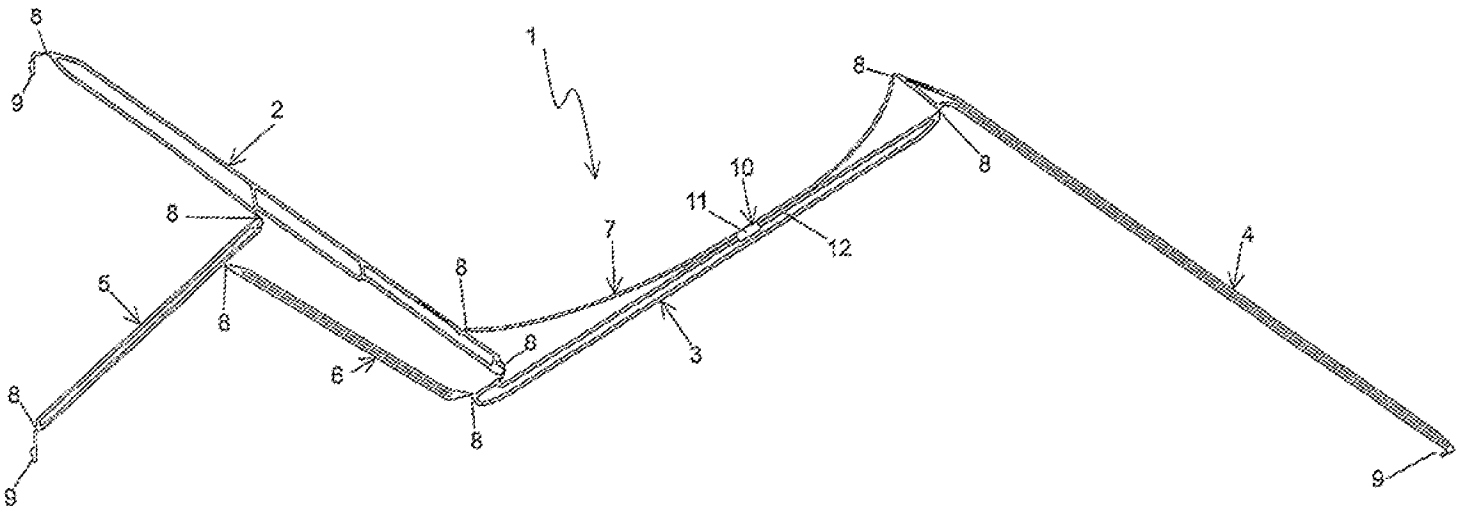
FIG. 1 shows a foldable articulated arm in accordance with a first embodiment of the invention.
Figure 4:
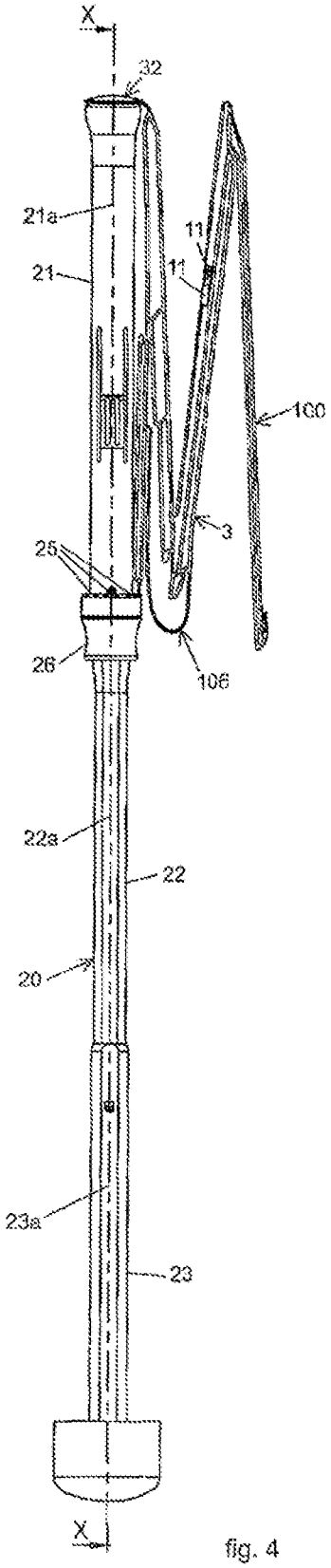
FIG. 4 shows the foldable articulated arm of FIG. 2, combined with a telescopic tube of an umbrella in an extended arrangement, in accordance with the present invention.
Figure 6:
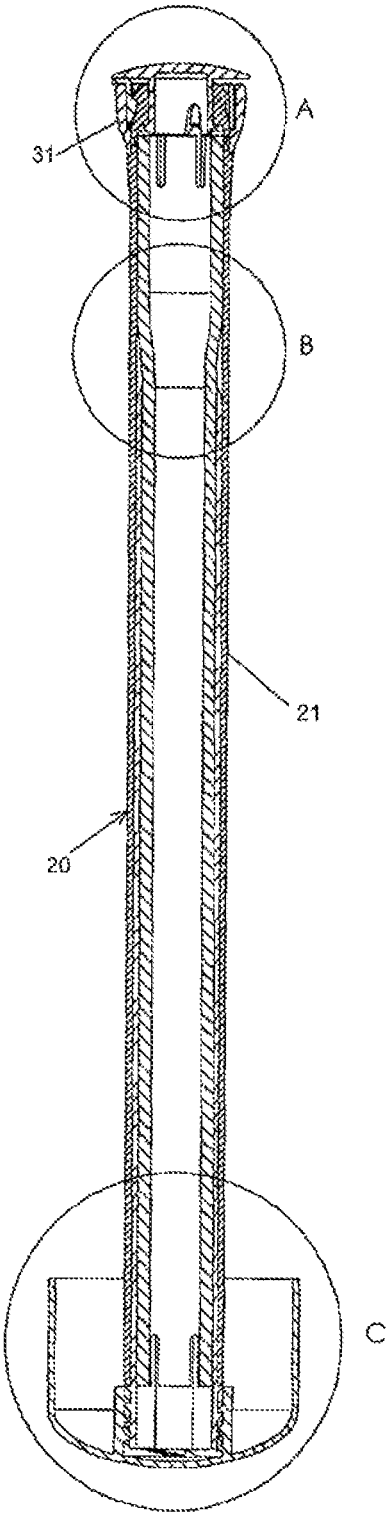
FIG. 6 is a longitudinal sectional view of the telescopic tube according to the Y-Y arrows of FIG. 5, in which a detail of the combining of the foldable articulate arm of FIG. 4 is partly shown.
Figure 7A:
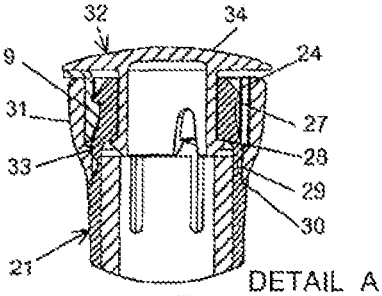
Figure 7B:
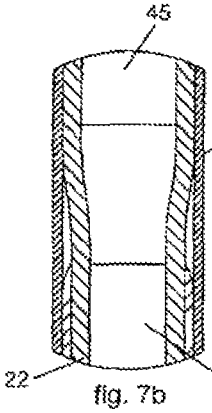
Figure 7C:
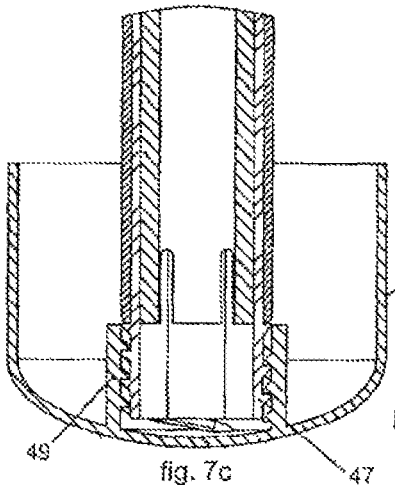
Figure 14:
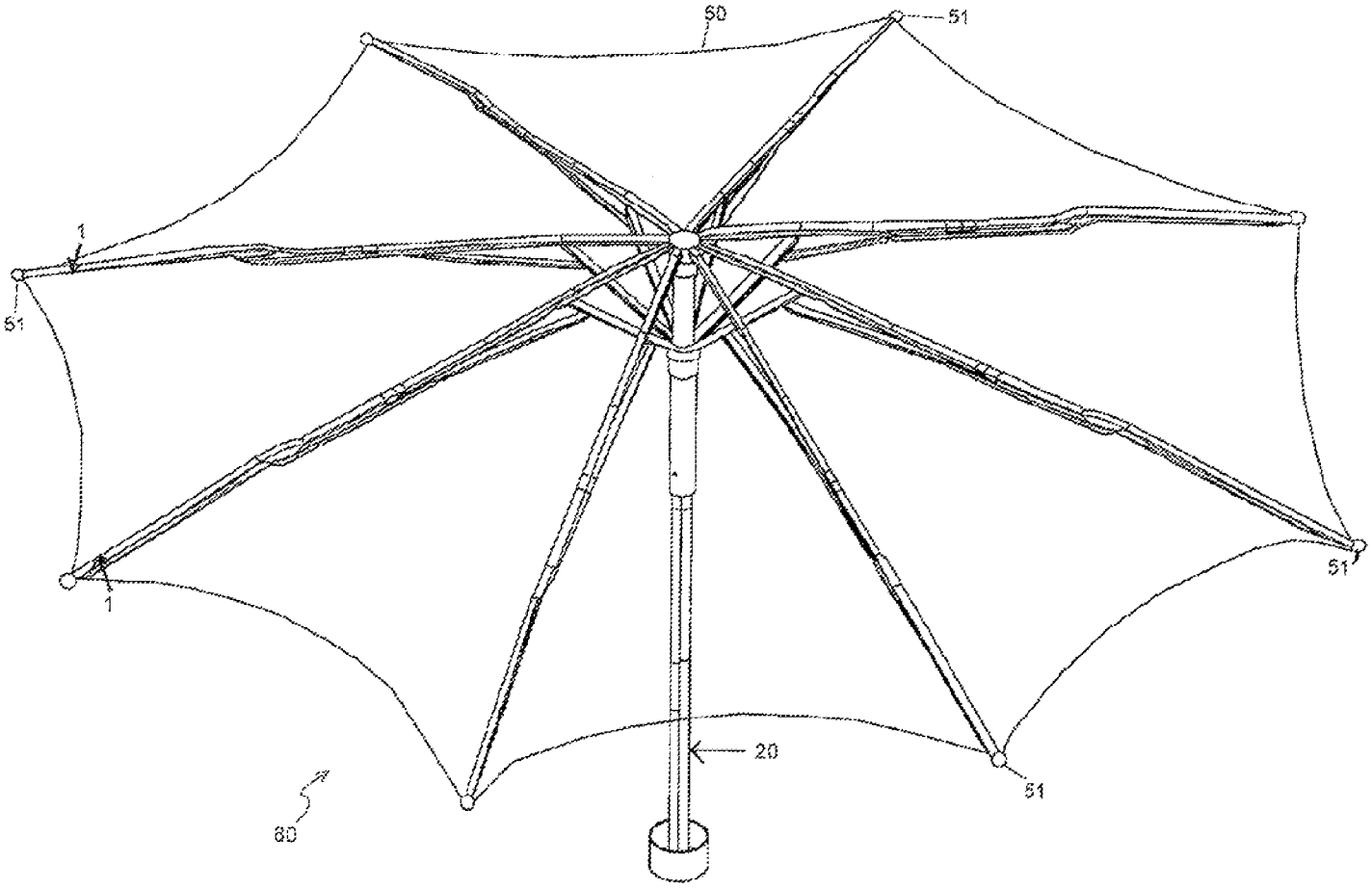

FIGS. 7*a*, 7*b* and 7*c* are enlarged details of the telescopic tube of FIG. 6;

FIG. 8 is a longitudinal sectional view of the telescopic tube according to the X-X arrows of FIG. 4;

FIGS. 9*a*, 9*b* and 9*c* are enlarged details of the telescopic tube of FIG. 8;

FIGS. 10 and 11 are longitudinal sectional views of the telescopic tube of FIG. 8, in extended and respectively withdrawn arrangement, in accordance with an alternative embodiment of the invention;

FIGS. 12*a*, 12*b*, 12*c* and 12*d* are enlarged details of the tube of FIG. 10;

FIGS. 13*a*, 13*b* and 13*c* are enlarged details of the telescopic tube of FIG. 11;

FIG. 14 is a perspective view of a foldable umbrella according to the present invention comprising a plurality of foldable articulated arms of the type shown in FIG. 1.

DETAILED DESCRIPTION OF THE INVENTION

A foldable articulated arm for umbrellas according to a first embodiment of the invention is shown in FIG. 1, in which it is denoted on the whole with numeral 1.

In accordance with a first aspect of the invention, the foldable articulated arm 1 is made in a single piece of plastic material, for example by injection molding.

In the foldable articulated arm 1 three segments or portions can essentially be observed which are foldable one on another, and specifically two ending portions arranged at parts opposite to an intermediate portion, each one including a respective rod-shaped element.

The foldable articulated arm 1 comprises a first rod-shaped element 2, a second rod-shaped element 3 and a third rod-shaped element 4, which can have an arrangement in which they are folded one on another, or they can have an extended arrangement, due to a plurality of stretching elements of the rod-shaped elements themselves and a plurality of joint elements of the rod-shaped elements and stretching elements.

Specifically and in accordance with FIG. 1, the articulated arm 1 comprises three stretching elements which are arranged, together with the three rod-shaped elements, to form a system of four-bar linkages.

In detail, the first rod-shaped element 2 has one free end and one opposite end hinged to the second rod-shaped element 3 which in turn has one end hinged to the third rod-shaped element 4 also having one free end.

Of the at least three stretching elements, a first stretching element 5 has one free end and one opposite end hinged to the first rod-shaped element 2, a second stretching element 6 has one end hinged to the first stretching element 5 and one opposite end hinged to the second rod-shape element 3 whereas a third stretching element 7 has one end hinged to the first rod-shaped element 2 and one opposite end hinged to one end of the third rod-shaped element 4.

The three rod-shaped elements and the three stretching elements are combined one to each other, according to the above described system of four-bar linkages by the afore said joint elements, specifically by a plurality of joint elements denoted with numeral 8, which as above mentioned are made in a single piece with the rod shaped or stretching elements themselves, and which, in accordance with an aspect of the invention, make a respective hinged end, each one of them being realized in a limited set length portion, of the respective rod-shaped or stretching element, having a reduced cross section with respect to a main body of the rod-shaped or stretching element itself, so that to be particularly flexible or foldable.

In accordance with a further aspect of the invention the foldable articulated arm 1 comprises, at the opposite ends and particularly at the free ends of the first rod-shaped element 2, of the first stretching element 5 and the third rod-shaped element 4, retaining means 9 for a respective combining or constraint with a tube and a sheet of an umbrella, as shown in the example of FIG. 14.

The retaining means 9 comprise tooth-shaped ending portions of the afore said free ends forming the male component of a so called "snap-fit" coupling, that is to say a substantially irreversible snap-fit coupling.

Further the ending portions comprising the tooth have a reduced cross section with respect to a main body of the respective rod-shaped or stretching element, that is to say they comprise respective joint elements 8.

Still as regard to the stretching elements, it should be said that the third stretching element 7 is advantageously a flexible ribbon which, in accordance with the example shown in FIG.

1, is constrained to the second rod-shaped element 3, by a runner 10 sliding on the second rod-shaped element.

In accordance with the invention, the runner 10 is realized in a single piece with the flexible ribbon and comprises a first lug and a second lug, denoted by numeral 11, of limited set length, which jut from opposite edges of the flexible ribbon perpendicularly to it, each one having a right-angle folded edge slidingly engaging a respective, longitudinal, groove 12, provided on the sides of the second rod-shaped element 3.

The first and second lugs 11 are in practice arranged facing one another on the flexible ribbon, in positions shifted one to another.

As regard in general the above described rod-shaped elements and stretching elements, except for the third stretching element 7, as a flexible ribbon, and the hinged ending portions, that is to say the joint elements 8, it should be added that they are rigid or semi-rigid elements, depending on the plastic material used and the size of the respective section.

Thereupon it also has to be said that the rigid or semi-rigid elements can have the same cross section, by shape and/or size, or different one from another, by shape and/or size, and particularly they can have "I", or "T" or "H" cross section.

Figure 2:
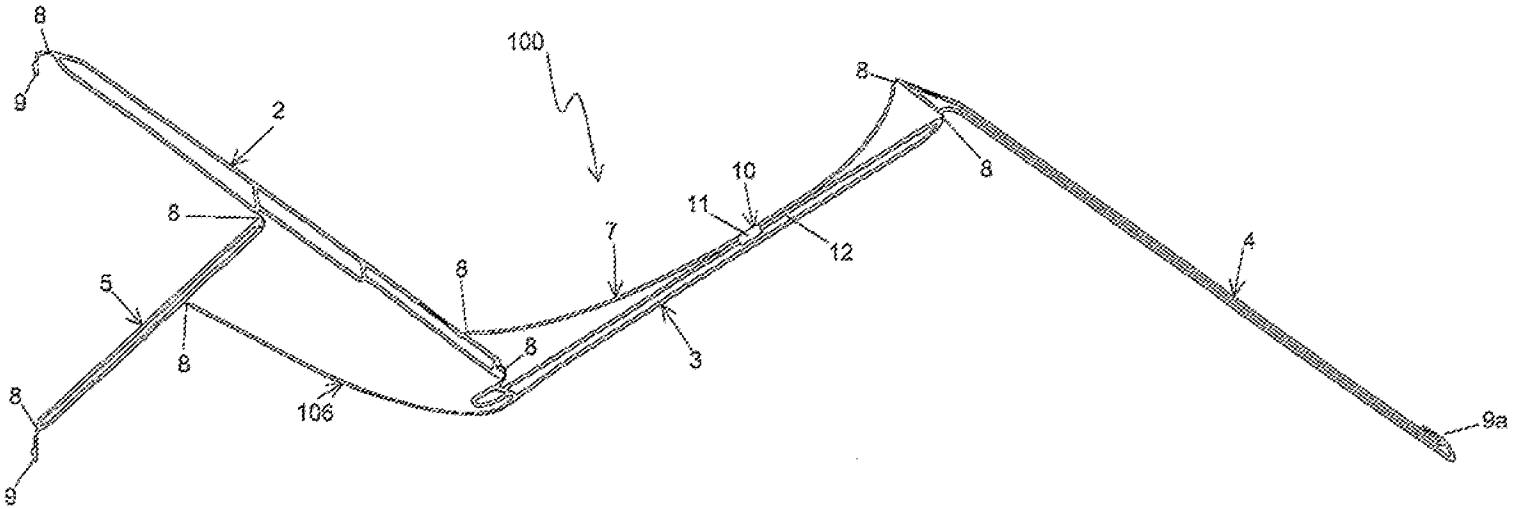
FIG. 2 shows the foldable articulated arm of FIG. 1 in accordance with a second embodiment of the invention.

In accordance with an alternative embodiment shown in the examples of the FIGS. 2 and 4, wherein parts structurally and operatively similar to those of the above described example of FIG. 1 have the same reference numerals, the present invention provides a foldable articulated arm 100, similar to the arm 1 but having a second stretching element 106 having the shape of a flexible ribbon.

Specifically, the second stretching element 106 having the shape of a flexible ribbon has one end combined with the first stretching element 5 and one opposite end combined with the second rod-shaped element 3, specifically combined with one end of the second rod-shaped element 3, or combined with a back face thereof, as shown in the example of FIG. 2.

The foldable articulated arm 100 differs from the above described foldable articulated arm 1 besides for the afore said second rod-shaped element, for the shape of the retaining means of the third rod-shaped element 4 too, which in the specific case materialized in an ending portion folded on the same third rod-shaped element 4, in practice a tab denoted by numeral 9*a*, defining a. notch between the tab and a main body of the third rod-shaped element. In the example of FIG. 4 the foldable articulated arm 100 is shown combined with a tube of an umbrella, and it shows the runner, and in particular the first and second lugs 11 of the runner, separated from the second rod-shaped element 3.

Figure 3:
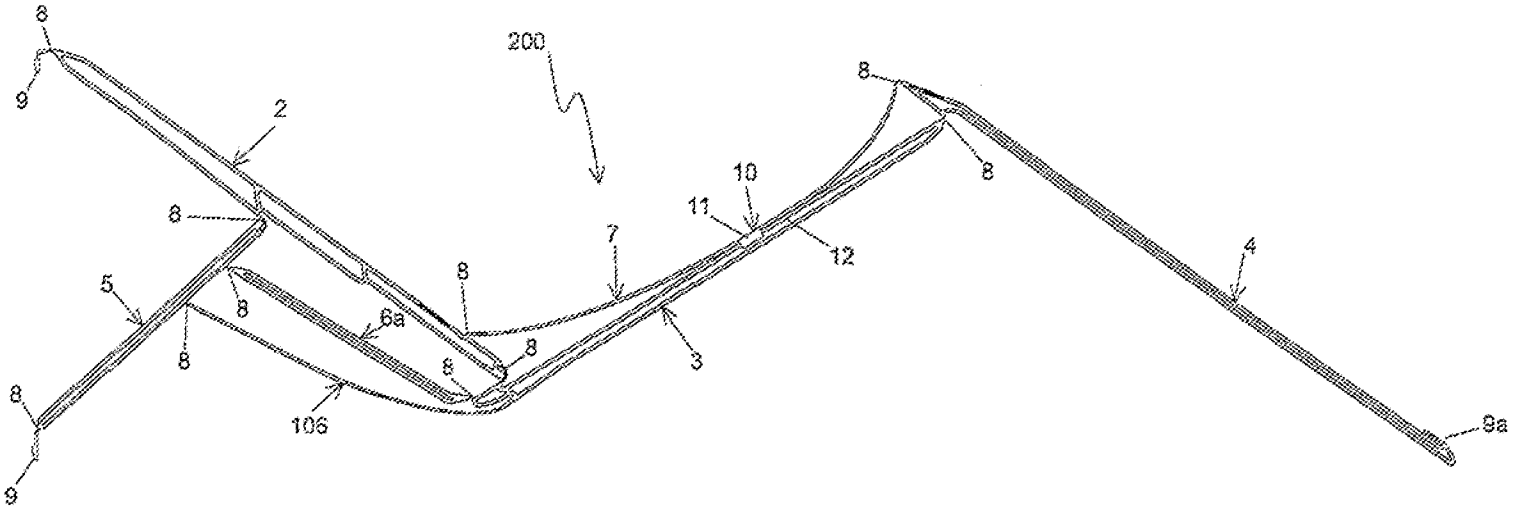
FIG. 3 shows the foldable articulated arm of FIG. 1, in accordance with a further embodiment of the invention.

In accordance with a further alternative embodiment shown in the example of FIG. 3, wherein parts structurally and operatively similar to those of the above described previous examples have the same numeral references, the present invention provides a foldable articulated arm 200, similar to the arms 1 and 100, further comprising a fourth, rigid or semi-rigid stretching element 6*a*.

Specifically, the fourth stretching element 6*a* has one end hinged to the first stretching element 5 and one opposite end hinged to the second rod shaped element 3, at an end thereof, and it is interposed between the first rod-shaped element 2 and the second stretching element 106 in the shape of a flexible ribbon having one end combined with the back side of the second stretching element 3.

Substantially the foldable articulated arm 200 comprises a stretching element corresponding to the second stretching element of the arm 1, and a stretching element corresponding to the second stretching element of the arm 100, besides the first 5 and third 7 stretching elements, as shown in the example of FIG. 3.

Further the foldable articulated arm 200 is shown with retaining means of the third rod-shaped element 4 having the shape of folded ending portion 9*a*, or tab folded on the same third rod-shaped element 4, similarly to the foldable articulated arm 100 of FIG. 2, but it is understood that such a solution can be replaced by tooth-shaped retaining means and similar coupling means as shown above, either one or the other embodiment in each one of the foldable articulated arms according to the present invention being possible to provide.

As reported referring to the above mentioned FIGS. 4 and 14, the foldable articulated arm according to the invention is adapted to be combined with an umbrella tube and sheet.

In accordance with a feature of the invention, a plurality of foldable articulated arms, of the above described type, are all combined with a telescopic tube 20 at the side of the free ends of the first rod-shaped element 2 and the first stretching element 5, and with a sheet 50 at the side of the free end of the third rod-shaped element 4, particularly at the retaining means 9 or 9*a*, provided on such free ends, to form all together a foldable umbrella 60.

Figure 5:
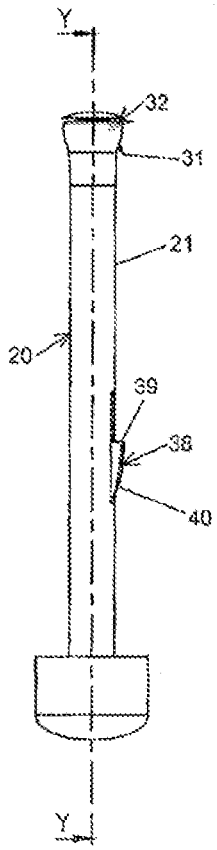
FIG. 5 is a yew of the telescopic tube shown in FIG. 4 in a withdrawn arrangement.

Particularly the tube 20, which is also shown in the examples of FIG. 5 in withdrawn arrangement, of FIG. 6 in section and still withdrawn and of FIG. 8 in section and in an extended arrangement, essentially comprises three tubular elements.

In detail, a first tubular element 21, the plurality of foldable articulated arms is combined therewith, a second tubular element 22 slidingly mounted inside the first tubular element 21 and adapted to slide between a first position in which it is substantially inside the first tubular element and a second position in which it is at least partially outside of the first tubular element 21, and a third tubular element 23 slidingly mounted outside of the second tubular element 22 and adapted to slide between a first position in which it is substantially inside the first tubular element and a second position in which it is at least partially outside thereof and the second tubular element.

Preferably, the first tubular element 21 and one ending portion of the second tubular element 22, substantially the ending portion of the latter intended to remain inside the first tubular element 21 in any relative sliding position between such tubular elements, as it will be better evident in the following, have an elliptical section.

Further, the second tubular element 22 may comprise a track 22*a* engaging respective guides 21*a* and 23*a* present inside the first tubular element 21 and respectively inside the third tubular element 23 so to prevent the relative rotation between the tubular elements.

For the combining of the plurality of foldable articulated arms with the tube 20, the umbrella 60 comprises suitable housing seats of the retaining means 9 the afore said teeth), of the first rod-shaped element 2 and the first stretching element 5 which form respective female components for the afore said "snap-fit" coupling.

A first plurality of housing seats denoted with numeral 24 for the retaining means 9 of the first rod-shaped elements 2 is provided at one end of the first tubular element 21 and a second plurality of housing seats 25 for the respective plurality of retaining means 9 of the first stretching elements 5 is provided on one annular element 26, fitted onto the first tubular element 21 and sliding on it between a first position in which the afore said articulated arms are closed and a second position in which the afore said articulated arms are extended.

In detail, the first tubular element 21 has an ending portion in which, moving away from the vertex, a first outer annular throat 27, a first inner annular step 28, a second outer annular throat 29 (or alternatively a pair of outer semicircular throats substantially symmetrical one to another), and a second outer annular step 30 are defined, as can be seen in the examples of FIGS. 7*a* and 9*a* which show the ending portion of the first tubular element 21 with the tube in withdrawn arrangement and a tooth of the retaining means 9 of a foldable articulated arm combined with it and respectively with the tube in extended arrangement without combined foldable articulated arm.

Again, the umbrella 60 comprises an ending or head element 31, substantially a sleeve with flared profile, fitted onto the end of the first tubular element 21 and a closing plug 32 of the first tubular element 21 and the ending element 31.

The ending element 31 has a lower edge in abutment onto the afore said second outer step 30 of the first tubular element 21 and delimits a circular crown with it defining the first plurality of housing seats 24.

In practice the ending element 31 has an inner annular step and a plurality of longitudinal inner ribs, which in the afore said circular crown delimit the plurality of housing seats 24 for the retaining means 9 of respective first rod-shaped elements 2. When the plurality of housing seats 24 is engaged by the retaining means 9, a snap-fit coupling among these latter is obtained, the ending element 31 and the first tubular element 21, specifically by an inner annular lug 33 of the ending element 31 engaging the second outer annular throat 29 for alternatively the pair of semicircular throats as shown above) of the end of the first tubular element 21. Also the plug 32, essentially comprising a lid 34 from which a cylindrical body 35 having an outer annular lug 36 extends, is snap-fit coupled to the first tubular element 21, the outer annular lug 36, which substantially defines an annular step, cooperating with the first inner annular step 28 of the first tubular element 21.

The assembly comprises the ending portion of the first tubular element 21, the ending element 31 fitted onto it, the plug 32 closing them and the retaining means 9 of the first rod shaped elements 2 of the foldable articulated arms combined with the tube 20, is further strengthened in the above described combining due to the presence of longitudinal, cuts 37, provided in the cylindrical body 35 of the plug 32, which provide it with resiliency and determine a thrust of the outer annular lug 36 towards the first inner annular step 28 of the first tubular element 21, and further strengthened by the lid 34 of the plug 32 still acting as stop, element on the retaining means 9, specifically on the joint elements 8 having the tooth-shaped ends.

As regard to the annular element 26 with which the retaining means 9 of the first stretching element 5 of the foldable articulated arms in accordance with the invention are associated, it has to be added that the second plurality of housing seats 25 provided within is substantially similar to the above described first plurality of housing seats 24, meaning that the housing seats 25 are arranged circumferentially on the annular element 26, and each one extends substantially parallel to the axis of the tube 20.

Again the umbrella 60 comprises stopping means of the travel of the annular element 26 and stopping means of the travel of the tubular elements which limit the mutual sliding, which are made integral with the tube 20 in accordance with an embodiment of the invention.

In particular first stopping means 38 of the annular element 26 are provided integral with the first tubular element 21 which are a lug 39 jutting from the body of the first tubular element 21 and obtained on a notched portion thereof denoted by numeral 40.

The lug 39 can be positioned on the portion notched at half height thereof between two parallel longitudinal notches, as shown in the example of FIG. 4, or it can be on a free end, upper or lower, of the notched portion 40.

As regard to the afore said means for stopping the mutual travel of the tubular elements, in the embodiment in which they are integral with the same tubular elements shown referring to the examples of FIGS. 7*a*, 7*b*, 7*c*, 9*a*, 9*b* and 9*c*, it has to be mentioned that the second tubular element 22 comprises opposite ending portions, each one of which is provided with two pairs of cuts 41 defining a pair of spring elements 42, substantially two notched stripes or portions having a free end, of the tab type, with respective jutting edges 43 intended to engage respective recesses 44 provided inside the first tubular element 21 and the third tubular element 23 at the ending lengths thereof.

Specifically recesses 44 are provided, which can be annular housings or extended for a limited length on the inner wall of the first and third tubular elements, at both the ending portions thereof, thereby cooperating with the jutting edges 43 both as stopping means of the mutual sliding of the tubular elements, in an extended tube arrangement, and as retaining means for retaining the tubular elements in the withdrawn tube arrangement from the mutual sliding.

Again it has to be added, according to a further aspect of the invention and as previously mentioned, that the second tubular element 22 has an outwardly flared ending portion 45 and with elliptical section larger than a remaining portion thereof or main body 46 preferably having circular section.

In practice the portion 45 is a kind of head of the second tubular element 22, and the section difference from the main body 46 allows the second tubular element 22 to slide inside the first tubular element 21, that one of the three tubular elements with greatest section, and also to slide, limitedly to the main body 46, inside the third tubular element 23.

Still in accordance with the invention the umbrella 60 comprises combining means 47 of threaded type which are an outer threaded ending portion of the third tubular element 23, and a handle 48 removably combined with the tube 20 at said threaded portion.

The handle 48 which comprises a nut thread element 49, can therefore be replaced in case of failure or simply changed with a handle having different color and/or shape, according to the taste of the user.

Threaded portion and nut thread element can also be reversed with respect to the above described examples of FIGS. 7*c* and 8, and in particular an ending nut thread element in the third tubular element can be provided, having a standard diameter, for housing, once removed the handle, a known type bottleneck, for example a 0.5 liter bottle of water, as it will better appear in the following.

Obviously for beach or bar umbrella in accordance with the present invention, the handle is replaced by a base or foot, possibly still screw coupled to the tube of the umbrella, which advantageously can be hollow for its filling as desired, for example with water or sand, this embodiment not being shown in the figures.

Still, regarding the sheet 50, it has to be added that in accordance with an embodiment the umbrella according to the present invention comprises a plurality of fastening elements 51, as many as the foldable articulated arms, which in practice form respective caps to which the sheet is constrained at the relative apices.

Each one of the fastening means 51 is provided with a housing seat for a respective tooth-shaped retaining means 9, of a relative third rod-shaped element 4 of the foldable articulated arms composing the female component for a "snap-fit"coupling.

In accordance with the invention the sheet 50 is a film of plastic material fastened by welding to the plurality of fastening means 51, further the sheet is fastened to each one of the foldable articulated arms in two more points comprised between the tube 20 and the fastening means 51, again by welding.

Alternatively, the apices of the sheet 50 can be directly constrained to third rod-shaped elements, always by welding, in case the latter comprise retaining means having the shape of respective ending folded portions 9*a* of tab type, as previously described referring to the examples of FIGS. 2-4.

In accordance with a further embodiment, the present invention provides a variation of the tube of the present umbrella, shown with reference to the FIGS. 10, 11, 12*a*-12*d* and 13*a*-13*c*, wherein structurally and operatively parts corresponding to those of the previously described embodiments maintain the same reference numerals.

Specifically in the afore said figures a tube 500 is shown comprising three tubular elements linked one to another in the same way as the tubular elements of the tube 20 which description is referred to.

The main difference from the tube 20 is in the inversion of screw-nut thread between handle and tubular element, and in the means for stopping the mutual travel of the tubular elements.

Specifically the tube 500 comprises a third tubular element 501, having an ending portion with nut thread 502 for the removable combining with a handle 503 comprising a relative threaded portion 504, or alternatively with a bottleneck as above suggested.

In the examples of the afore said figures the handle 503 has a drop shape and preferably is made of plastic material.

As regard to the above means for stopping the mutual travel of the tubular elements of the tube, it has to be added that they materialize in two elastic or weak elements 505, each one combined with the second tubular element of the tube 500, in the afore said figures denoted by numeral 506, at relative ending portions, and each one provided with an outwardly jutting plug 507, engaging and overlooking from a respective through hole provided at the same ending portions of the second tubular element 506.

The elastic elements 505, which in practice have a hooked folded shape, act as a spring making the plugs 507 able to be withdrawn for an engagement/disengagement with respective housings 508 obtained at the ends of the first tubular element of the tube, denoted by numeral 509, and of the afore said third tubular element 501.

The plugs 507 can be made in a single piece with the second tubular element or they can be constrained to it.

The advantages of the present invention already appeared evident throughout the above reported description, can be summarized by pointing out that a foldable articulated arm is provided, which is made in a single piece of plastic material, being therefore particularly strong, light, cost effective, easy to carry out, having a reduced overall dimensions both in extended arrangement and in withdrawn arrangement, which is totally recyclable and easily to color and that therefore can be used in the carrying out of an umbrella according to the invention, which substantially maintains all the advantages of the foldable articulated arm.

The umbrella according to the invention, in fact, adds to the strength of the arms the strength of the couplings or the retaining means thereof with the tube and the sheet.

Further the arms are combined by the annular ring always and only with a tubular element of the tube, advantageously that one having larger diameter, increasing the strength of the structure of the umbrella.

Still, strength and compactness, as well as the advantages in the manufacturing timings, therefore economic advantages too, are obtained by the reduced number of components composing the present umbrella.

Still, by providing tube and sheet in recyclable plastic material, as the foldable articulated arms, the umbrella according to the invention is extremely advantageous since it can be wholly manufactured cost-effectively on a large scale, for the benefit of the user which could be provided with different umbrellas, for example with different colors, by taking advantage from and validating the aesthetic factor of the umbrella.

A person skilled of the art may make various changes to the present invention, in its illustrated and described embodiments, to satisfy contingent and specific requirements, on the other hand all contained in the protection scope of the invention as defined in the following claims.

The invention claimed is:

1. A foldable articulated arm comprising:

a first rod-shaped element, a second rod-shaped element and a third rod-shaped element foldable one to another;

at least three stretching elements connected to the rod-shaped elements to form a system of four-bar linkages, a plurality of joint elements connected to the rod-shaped elements and the stretching elements and having, at opposite ends, retaining means for a respective combining with a tube and an umbrella sheet, wherein the rod-shaped elements, the joint elements, the stretching elements and the retaining means are together constructed of a single piece of plastic material constituting the foldable articulated arm;

wherein of the at least three stretching elements, a first stretching element has one free end and one opposite end hinged to the first rod-shaped element, a second stretching element has one end hinged to the first stretching element and one opposite end hinged to the second rod-shaped element and a third stretching element has one end hinged to the first rod-shaped element and one opposite end hinged to one end of the third rod-shaped element, and wherein the third stretching element comprises a flexible ribbon;

a runner slidable on the second rod-shaped element and constraining the flexible ribbon of the third stretching element to the second rod-shared element;

wherein the second stretching element comprises a flexible ribbon having one end combined with a back side of the second rod-shaped element and one end with the first stretching element.

2. The foldable articulated arm according to claim 1, wherein the runner is integral with said third stretching element.

3. The foldable articulated arm according to claim 2, wherein said runner comprises at least one right-angle folded lug jutting from an edge of said flexible ribbon.

4. The foldable articulated arm according to claim 1, further comprising a fourth stretching element having one end hinged to said first stretching element and one opposite end hinged to said second rod-shaped element, interposed between the first rod-shaped element and the second stretching element.

5. The foldable articulated arm according to claim 1, wherein each one of said joint elements make one hinged end of a respective rod-shaped or stretching element, essentially comprising one ending portion, of set limited length, of said respective rod-shaped or stretching element, having a reduced cross section with respect to a main body of the respective rod-shaped or stretching element, to be flexible or foldable.

6. The foldable articulated arm according to claim 1, wherein said retaining means comprise tooth-shaped ending portions of a free end of said first rod-shaped element, said third rod-shaped element and said first stretching element, which constitutes at least one chosen from a male component of a snap-fit coupling and, for said third rod-shaped element, an ending portion folded on itself.

7. The foldable articulated arm according to claim 1, wherein said main bodies of said rod-shaped elements and of said stretching elements are made of a first high density plastic material, and wherein at least one chosen from the joint elements and the retaining means are made of a second plastic material with density lower than said first plastic material.

8. An umbrella comprising a tube, a sheet and a plurality of foldable articulated arms according to claim 1 constrained to said tube and said sheet at said retaining means.

9. The umbrella according to claim 8, wherein said tube is telescopic and it comprises at least three tubular elements, a first tubular element, to which the plurality of foldable articulated arms is combined, having a largest section among sections of said tubular elements.

10. The umbrella according to claim 9, wherein among said at least three tubular elements, a second tubular element is slidingly mounted inside said first tubular element, and is configured to slide between a first position in which it is substantially inside the first tubular element and a second position in which it is at least partially outside of the first tubular element, and a third tubular element slidingly mounted outside of said second tubular element and configured to slide between a position in which it is substantially inside the first tubular element and a position in which it is at least partially outside thereof and the second tubular element.

11. The umbrella according to claim 10, comprising a first and a second plurality of housing seats, the first plurality of housing seats positioned in the first tubular element, the second plurality of housing seats being positioned on at least one chosen from the second and third tubular elements, which form relative female components of the snap-fit coupling.

12. The umbrella according to claim 11, further comprising an annular element fitted onto said first tubular element and slidingly constrained thereto between a first position in which said articulated arms are closed and a second position in which said articulated arms are extended, said annular element comprising said second plurality of housing seats.

13. The umbrella according to claim 12, comprising stopping means of the travel of said annular element made in a single piece with said first tubular element.

14. The umbrella according to claim 8, comprising stopping means of the mutual travel of said tubular elements made integral with the tubular elements.

15. The umbrella according to claim 8, comprising threaded combining means arranged at an ending portion of said third tubular element, and a handle or base removably combined with said third tubular element at said threaded combining means.

16. The umbrella according to claim 8, further comprising a plurality of fastening elements, each one having a housing seat for a retaining element having the shape of a tooth of a third rod-shaped element of a respective foldable articulated arm, said sheet being fastened at relative apices to said plurality of fastening elements.

17. The umbrella according to claim 8, wherein said sheet is directly constrained at relative apices to said retaining means in the shape of folded ending portions of each one of said third rod-shaped elements.

18. The umbrella according to claim 8, wherein said sheet is a film of plastic material.

19. The umbrella according to claim 8, wherein said sheet is welded to at least one chosen from said plurality of foldable articulated arms and to said plurality of fastening elements.

20. The umbrella according to claim 8, wherein the entire umbrella is made of at least one chosen from recyclable and recycled plastic material.

* * * * *